US008770955B2

(12) United States Patent
Lamparski

(10) Patent No.: US 8,770,955 B2
(45) **Date of Patent: *Jul. 8, 2014**

(54) ADJUSTABLE ROTARY PUMP WITH REDUCED WEAR

(75) Inventor: Christof Lamparski, Mittelbiberach (DE)

(73) Assignee: Schwabische Huttenwerke Automotive GmbH, Aalen (DE)

( * ) Notice: Subject to any disclaimer, the term of this patent is extended or adjusted under 35 U.S.C. 154(b) by 49 days.

This patent is subject to a terminal disclaimer.

(21) Appl. No.: 13/464,206

(22) Filed: May 4, 2012

(65) Prior Publication Data

US 2012/0219448 A1 Aug. 30, 2012

Related U.S. Application Data

(60) Division of application No. 13/079,270, filed on Apr. 4, 2011, now Pat. No. 8,186,982, which is a continuation of application No. 11/737,397, filed on Apr. 19, 2007, now abandoned.

(30) Foreign Application Priority Data

Apr. 19, 2006 (DE) ..... 10 2006 018 124

(51) Int. Cl.

| | |
|---|---|
| ***F01C 1/18*** | (2006.01) |
| ***F01C 1/24*** | (2006.01) |
| ***F01C 20/18*** | (2006.01) |
| ***F04C 2/18*** | (2006.01) |
| ***F04C 2/24*** | (2006.01) |
| ***F04C 28/18*** | (2006.01) |

(52) U.S. Cl.
USPC ..... 418/206.9; 418/206.1; 418/21; 418/28; 418/1; 418/178; 418/179

(58) Field of Classification Search
USPC ..... 418/1, 21, 28, 178, 179, 206.1, 206.9
See application file for complete search history.

(56) References Cited

U.S. PATENT DOCUMENTS

| | | | |
|---|---|---|---|
| 2,620,516 | A | 12/1952 | Muller |
| 2,621,166 | A | 12/1952 | Schmidt |
| 2,729,618 | A | 1/1956 | Muller |
| 2,897,248 | A | 3/1959 | Nischk |
| 3,015,283 | A | 1/1962 | Knipp |
| 4,666,786 | A | 5/1987 | Yano |

(Continued)

FOREIGN PATENT DOCUMENTS

| | | |
|---|---|---|
| DE | 3503859 | 9/1985 |
| DE | 3528651 | 2/1987 |

(Continued)

*Primary Examiner* — Mary A Davis
(74) *Attorney, Agent, or Firm* — RatnerPrestia

(57) ABSTRACT

A rotary pump having a variable delivery volume, including: a casing; a delivery chamber formed in the casing; at least one delivery rotor which is rotatable in the delivery chamber; an actuating member which is arranged facing a front face of the delivery rotor or surrounds the delivery rotor, and is moveable in the casing for adjusting the delivery volume; the actuating member chargeable with an actuating force which is dependent on a fluid requirement; a track which is formed in the casing and guides the actuating member on an actuating member sliding surface in a sliding contact; and a sliding material which forms at least one of the track and the actuating member sliding surface.

30 Claims, 1 Drawing Sheet

(56) References Cited

U.S. PATENT DOCUMENTS

| | | | | |
|---|---|---|---|---|
| 4,703,076 | A | 10/1987 | Mori | |
| 4,740,142 | A | 4/1988 | Rohs | |
| 4,761,124 | A | 8/1988 | Timuska | |
| 5,165,881 | A | 11/1992 | Wicen | |
| 5,484,271 | A | 1/1996 | Stich | |
| 5,554,020 | A | 9/1996 | Rao et al. | |
| 5,763,072 | A | 6/1998 | Kato | |
| 5,879,791 | A | 3/1999 | Kato et al. | |
| 6,283,735 | B1 | 9/2001 | Schreiber et al. | |
| 6,461,128 | B1 | 10/2002 | Wood | |
| 6,470,788 | B2 | 10/2002 | Specht | |
| 6,604,922 | B1 | 8/2003 | Hache | |
| 6,867,532 | B2 | 3/2005 | Brady | |
| 6,983,681 | B2 | 1/2006 | Iwata et al. | |
| 8,186,982 | B2 * | 5/2012 | Lamparski | 418/206.9 |
| 2001/0024618 | A1 | 9/2001 | Winmill | |
| 2006/0111501 | A1 | 5/2006 | Cont et al. | |
| 2007/0009757 | A1 | 1/2007 | Takayama et al. | |

FOREIGN PATENT DOCUMENTS

| | | | |
|---|---|---|---|
| DE | 4200305 | | 7/1993 |
| DE | 69510526 | | 12/1999 |
| DE | 20020695 | | 3/2001 |
| DE | 10222131 | | 12/2003 |
| DE | 102004012726 | | 10/2005 |
| DE | 102004030321 | A1 | 1/2006 |
| DE | 102004033968 | | 2/2006 |
| EP | 0040448 | | 11/1981 |
| EP | 0223268 | | 5/1987 |
| JP | 05052222 | A | 3/1993 |
| JP | 05230283 | A | 9/1993 |
| JP | 2002242852 | | 8/2002 |
| WO | WO 2005/024076 | A1 | 3/2005 |

* cited by examiner

ADJUSTABLE ROTARY PUMP WITH REDUCED WEAR

This application is a Divisional application of U.S. patent application Ser. No. 13/079,270, filed Apr. 4, 2011, which is a Continuation application of U.S. patent application Ser. No. 11/737,397, filed Apr. 19, 2007, which claims priority of German Patent Application No. 10 2006 018 124.7, filed Apr. 19, 2006, which are incorporated in their entirety herein by reference.

BACKGROUND OF THE INVENTION

1. Technical Field

The invention relates to a rotary pump having an adjustable, preferably variable, delivery volume, and a method for manufacturing it. The rotary pump can in particular be used as a lube oil pump for supplying lube oil to an internal combustion engine, in particular an internal combustion engine of a motor vehicle engine.

2. Description of the Related Art

Lube oil pumps in motor vehicles are driven in accordance with the rotational speed of the engine which is to be supplied with the lube oil, usually directly or via a mechanical gearing of the engine. The rotational speed of the pump correspondingly increases with the rotational speed of the engine. Since rotary pumps have a constant specific delivery volume, i.e. they deliver substantially the same amount of fluid per revolution at any rotational speed, the delivery volume increases in proportion to the rotational speed of the pump. The engine's requirement also increases roughly in proportion to the rotational speed of the engine, up to a certain limiting rotational speed, beyond which however it deviates or at least levels out, such that when the limiting rotational speed is exceeded, the rotary pump delivers beyond the requirement. Adjustable rotary pumps have been developed in order to not have to direct the excess delivered amount into a reservoir, which incurs losses. Examples of adjustable rotary pumps include the internal-axle and external-axle toothed wheel pumps known from DE 102 22 131 B4. Adjustable vane pumps are also known. These pumps each comprise an actuating member which can be moved back and forth. In the examples cited, the delivery rotor is either a toothed wheel or a vane. In the known internal-axle toothed wheel pumps and vane pumps, the movement of the adjusting member adjusts the eccentricity between two mutually mating toothed wheels or the eccentricity between the vane and the actuating member in accordance with the requirement of the consumer. In external-axle toothed wheel pumps, the axial engagement length of two toothed wheels is adjusted. For adjusting, the respective actuating member is charged with an actuating force, for example charged directly with the high-pressure fluid.

The actuating force is counteracted by a spring member. In pumps of the type cited, which are increasingly manufactured from light metal alloys, in particular aluminum alloys, the surfaces of the pump casing and of the actuating member which are in frictional contact are surprisingly subject to particular wear and determine the service life of the pump.

SUMMARY OF THE INVENTION

An exemplary embodiment of the invention is based on a displacement-type rotary pump which comprises a casing including a delivery chamber, a delivery rotor which can be rotated in the delivery chamber about a rotational axis, and at least one actuating member which can be moved back and forth in the casing. The actuating member can surround the delivery rotor or preferably can be arranged on, i.e. facing, a front face of the delivery rotor. An actuating member which surrounds the delivery rotor can in particular be provided in internal-axle pumps, for example toothed ring pumps and vane pumps, and can be formed as a rotationally mounted eccentric ring such as is known from DE 102 22 131 B4 or EP 0 846 861 B1, or as a lifting ring. Preferably, however, an actuating member such as is known from external toothed wheel pumps, for example from DE 102 22 131 B4, is arranged on or facing a front face of the delivery rotor and axially seals the delivery chamber on the relevant front face. Such an actuating member forms an actuating piston which can be axially moved back and forth along the rotational axis of the feed wheel. An actuating member which surrounds the delivery rotor is rotationally or pivotably mounted, or alternatively can also be mounted such that it can be moved linearly. The delivery chamber comprises a low-pressure side and a high-pressure side. At least one inlet is arranged on the low-pressure side, and at least one outlet for a fluid to be delivered is arranged on the high-pressure side. The low-pressure side of the delivery chamber and the entire upstream portion of the system in which the pump is installed form the low-pressure side of the pump. The high-pressure side of the delivery chamber and the entire subsequent downstream portion of the system form the high-pressure side of the pump. The low-pressure side extends as far as a reservoir for the fluid, and the high-pressure side extends at least as far as the most downstream point of consumption requiring a high fluid pressure.

The actuating member can be charged with an actuating force in the direction of its mobility, said force being dependent on the pressure of the fluid on the high-pressure side of the pump or on another variable of the system which is decisive for the requirement. The pressure can be taken directly at the outlet of the delivery chamber or at a downstream pump outlet or can be taken from a point further downstream in the system, for example from the final point of consumption. Instead of or in addition to the pressure, the temperature of the fluid or of a component in the system in which the pump is installed, for example a temperature of the engine, can for example feature in forming the actuating force. Other physical variables for determining the actuating force are adduced as applicable. The actuating force can be generated by means of an additional actuating member, for example an electric motor. More preferably, however, the actuating member can be directly charged with the pressure of the fluid, i.e. during operation of the pump, it is charged with the pressurized fluid. In preferred embodiments, in particular in embodiments in which it is charged with the pressurized fluid, the actuating member is charged with an elasticity force which counteracts the actuating force. The elasticity force is generated by an elasticity member, preferably a mechanical spring.

The actuating member is in sliding contact with the casing, since the casing forms a track and the actuating member forms an actuating member sliding surface, and the actuating member is guided in the sliding contact by the track by means of its sliding surface. The actuating member can also additionally be guided in other ways, for example in a pivoting joint, however it is more preferably guided by the track only.

In accordance with the exemplary embodiment of the invention, the actuating member sliding surface and/or the track is/are formed from a sliding material. The sliding material can in particular be a plastic, a ceramic material, a nitride, a nickel-phosphorus compound, a sliding varnish, namely a lubricating varnish or solid film lubricant, a DLC coating, a Ferroprint coating or a nano-coating. The sliding material can form a surface coating. If the sliding material is a plastic, the relevant component—i.e. a casing portion forming the track, or the actuating member—can consist exclusively or at least substantially of the sliding material. In preferred embodiments, both the actuating member sliding surface and the track consist of a sliding material, either each of the same sliding material or each of a different sliding material. However, wear is also reduced even if only the actuating member sliding surface or only the track consists of the sliding material, wherein using the sliding material for the actuating member sliding surface is preferred.

The invention is based on the insight that furrowing, or conversely also adhesion, can be decisive for wear. Adhesion can in particular be the frictional mechanism which determines wear when the friction partners which are in sliding contact are so smooth that the frictional mechanism takes a back seat to furrowing or abrasion. It has for instance been established for adjustable external toothed wheel pumps that the actuating members arranged facing the front faces of the delivery rotor which can be axially moved, i.e. the two actuating pistons, are subject to considerable oscillating frictional wear. The adjusting movements required for setting the delivery volume are too slow to be causing the oscillating frictional wear. However, the adjusting movements are superimposed with oscillations having short strokes as compared to the varying movements and a substantially higher frequency. This therefore causes adhesion between the sliding surfaces of the actuating members and the track of the pump casing, resulting locally in material welding, which breaks away due to the adjusting movements. In accordance with the invention, the sliding partners—i.e. the sliding surface of the one or more actuating members and the one or more tracks of the casing—are configured such that the adhesion tendency in the friction system is significantly reduced as compared to the surfaces made of aluminum alloys which are usual for the sliding partners. The sliding material is advantageously chosen to exhibit an adhesion energy or free surface energy which is at most half the adhesion energy of pure aluminum. This condition is fulfilled in particular by plastic materials and ceramic materials, preferably metal oxide ceramics, but also by the other sliding materials cited above. The adhesion energy or free binding energy increases with the density of free electrons. Accordingly, the requirement for a low adhesion energy is fulfilled by materials having a low density of free electrons.

Heat-resistant thermoplasts are one group of materials which are particularly suitable as the sliding material. The one or—as applicable—more polymers of the plastic sliding material are advantageously modified to lubrication, i.e. the plastic contains a sliding additive which improves its sliding properties. Such a sliding material is also highly suitable in cases in which only one of the sliding partners of the friction system consists of a sliding material. A preferred sliding additive is graphite. Alternatively, a polymer from the group of fluoropolymers may above all be considered as a sliding additive. A preferred example from this group is polytetrafluoroethylene (PTFE). Particularly preferably, both graphite and at least one fluoropolymer, preferably PTFE, are added to the polymer, copolymer, polymer mixture or polymer blend, as sliding additives. The proportion of the sliding additive should be at least 10% by weight in total; preferably, the proportion of the sliding additive is 20±5% by weight in total. If different materials form the sliding additive, the individual proportions should be at least substantially the same. Plastic sliding materials containing 10±2% by weight of graphite and 10±2% by weight of fluoropolymer are for instance preferred. Adding fibrous material is also regarded as being advantageous, wherein carbon fibers are preferred as the fibrous material. Glass fibers should not be added, since they can form fine needle points on the surface of the sliding layer formed from the sliding material and therefore impair its sliding properties. The plastic sliding material preferably contains 10±5% by weight, more preferably 10±3% by weight of fibrous material.

Plastics which are preferred as the sliding material contain 70±10% by weight of polymer material. Although polymer mixtures or polymer blends may in principle be considered as the base material, the plastic sliding material preferably contains only one type of polymer. Polymers, with their long hydrocarbon chains, have a very low density of free electrons and also correspondingly few free spaces for free electrons of the sliding partner. Amorphous polymers, with their convoluted chains of molecules, are particularly advantageous in this regard. The degree of crystallinity of the polymer material should be as low as possible. Conversely, the polymer material should not have any practically significant entropy elasticity. The minimum working temperature should be around −40° C., preferably below this. The permanent working temperature should be at least +150° C. Within this range of working temperatures, a low creeping tendency, sufficient mechanical stability and dimensional stability are required. For its use in vehicle manufacturing, the plastic sliding material should also be resistant to fuel. Resistance to the fluid delivered should be a general requirement. It is also advantageous if the sliding material also has the ability to embed or absorb hard particles which can be created by furrowing, i.e. attrition. Preferred polymer materials are:

- polysulphone (PSU) or in particular polyether sulphone (PES), and copolymerides of PES and polysulphone (PSU);
- polyphenylene sulfide (PPS);
- polyether ketones, namely PAEK, PEK or in particular PEEK;
- polyphthalamide (PPA);
- and polyamide (PA).

In preferred first embodiments, the actuating member is formed from the plastic sliding material, preferably by injection molding. In such embodiments, it preferably consists of the plastic. In principle, however, inserts can be embedded in the plastic; in this sense, the actuating member at least substantially consists of the plastic sliding material. Instead of the actuating member, a casing portion which forms the track can also formed from the plastic sliding material, preferably by injection molding and from the plastic alone or at least substantially from the plastic, in the above sense. In a comparatively preferred variant, the casing is formed from a metal, preferably light metal, and the track is formed by an insert, preferably a bushing, consisting of the plastic sliding material. In principle, the actuating member and a casing portion which forms the track, in particular an insert, can also each be formed from the plastic sliding material. Within the context of the first embodiments, it is particularly preferred if only the actuating member consists at least substantially of the plastic sliding material, while the track is formed only as a surface coating by a plastic sliding material or, as applicable, another sliding material, or is formed as a non-coated metal surface.

In preferred second embodiments, at least one of the sliding surfaces which are in sliding contact is formed by a thin sliding layer. The actuating member and/or the casing portion forming the track consists or consists of another material below the superficial sliding layer, i.e. a substrate material. The substrate material can in particular be a metal, preferably a light metal. Prospective light metals are above all aluminum, aluminum alloys and magnesium alloys. In the second embodiments, both sliding surfaces are preferably formed as superficial sliding layers, each from a sliding material which has a significantly lower adhesion energy than aluminum or magnesium. If only one of the sliding surfaces of the two sliding partners consists of the sliding material, it is preferably the sliding surface of the actuating member. A combination of a first and second embodiment is also advantageous, wherein the actuating member or the casing portion forming the track, preferably an insert, at least substantially consists of plastic and the other part comprises a surface layer made of the sliding material, for example also made of plastic or made of a ceramic material.

The superficial sliding layer can be formed by applying the sliding material or by modifying the substrate material. Plastic sliding material is applied; preferably, the plastic is injection-molded around the blank formed from the substrate material. The plastic sliding material should exhibit a longitudinal thermal expansion which comes as close as possible to the longitudinal expansion of the substrate material. Modifying light-metal substrate materials, by contrast, creates a metal-oxide ceramic sliding layer or a nitride layer. If the substrate material is aluminum or an aluminum alloy, the sliding layer is preferably obtained by anodisation. Anodisation can in particular form a so-called Hardcoat® sliding layer or more preferably a so-called Hardcoat® smooth sliding layer. Hardcoat® smooth electrolytes consist of a mixture of oxalic acid and additives. Sulfuric acid ($H_2SO_4$) is generally used to manufacture Hardcoat® layers. Anodic oxidation methods for forming a metal-ceramic sliding layer comparable to $Al_2O_3$ sliding layers are also known for magnesium and magnesium alloys as the substrate material, for example the so-called DOW method. PTFE is preferably dispersed in the ceramic sliding layer; the ceramic is impregnated with PTFE, so to speak.

As already mentioned, the casing or also only a casing portion forming the track can in particular be formed from aluminum or an aluminum alloy. The casing or the relevant casing portion is preferably cast. The aluminum alloy is therefore preferably a cast aluminum alloy. If the actuating member does not at least substantially consist of plastic sliding material, it is preferably formed from aluminum or an aluminum alloy, preferably a cast alloy, preferably by casting and then extruding or by sintering and calibrating. It holds for both the casing portion and the actuating member that the respective aluminum alloy preferably contains 10±2% by weight of silicon. The respective alloy also preferably contains copper, though at a proportion of at most 4% by weight, preferably at most 3% by weight. It can furthermore contain a smaller proportion of iron. The casing portion, and preferably other portions of the casing, is or are preferably formed by sand casting or die casting, wherein die casting is primarily appropriate for larger-volume runs and sand casting is primarily appropriate for smaller-volume runs. Chill casting can also be used instead of sand casting. A particularly preferred alloy for the casing portion and also for the casing as a whole is AlSi8Cu3 if it is formed by sand casting or chill casting, and AlSi9Cu3 plus a small proportion of iron if it is formed by die casting.

Nitrides which are preferred as the sliding material are titanium carbon nitride (TiCN) and in particular nitrided steel. Steels having a high chromium content, preferably with a proportion of molybdenum and also preferably with a proportion of vanadium, for example 30CrMoV9, are in particular used as nitrided steels. TiCN is used as a surface coating on a light-metal substrate material. If nitrided steel forms the sliding material, the corresponding steel is preferably the substrate material. For instance, the actuating member can in particular be formed from the steel and the actuating member sliding surface can consist of the nitrided steel. A particularly preferred tribological pairing is Hardcoat® ceramic or Hardcoat® smooth ceramic for one sliding partner and nitrided steel for the other sliding partner. The ceramic sliding material of this pairing can contain PTFE, however low wear is also achieved when using the ceramic only. A tribological pairing of Hardcoat® ceramic or Hardcoat® smooth ceramic with sintered tin bronze is also an alternative, although only a conditionally preferred alternative with regard to its thermal expansion.

A DLC (diamond-like carbon) coating, and then in particular a tungsten carbide coating, also has a wear-reducing effect. A DLC sliding coating can in particular be produced by plasma-coating.

Sliding varnishes are also suitable sliding materials, wherein it also holds for sliding varnishes that, while wear is reduced even if only one of the sliding partners is coated, a sliding varnish coating on both sliding partners of the friction system is however preferred. A combination of a sliding varnish for one sliding partner and a plastic material for the other sliding partner is also an advantageous solution. The sliding varnish consists of an organic or inorganic binder, one or more solid lubricants and additives. $MoS_2$, graphite or PTFE, individually or in combination, may in particular be considered as the solid lubricant. Before being coated with the sliding varnish, the surface to be coated is pre-treated, expediently by forming a phosphate layer on the surface to be coated. One particular sliding varnish is Ferroprint, which contains fine steel tips as the solid lubricant.

If a nano-coating forms the sliding material, nano-phosphorus compounds can in particular form the sliding layer.

BRIEF DESCRIPTION OF THE DRAWINGS

Example embodiments of the invention are explained below on the basis of figures. Features disclosed by the example embodiments, each individually and in any combination of features which are not mutually exclusive, advantageously develop the subjects of the embodiments described above. There is shown.

DETAILED DESCRIPTION

Figure 1:
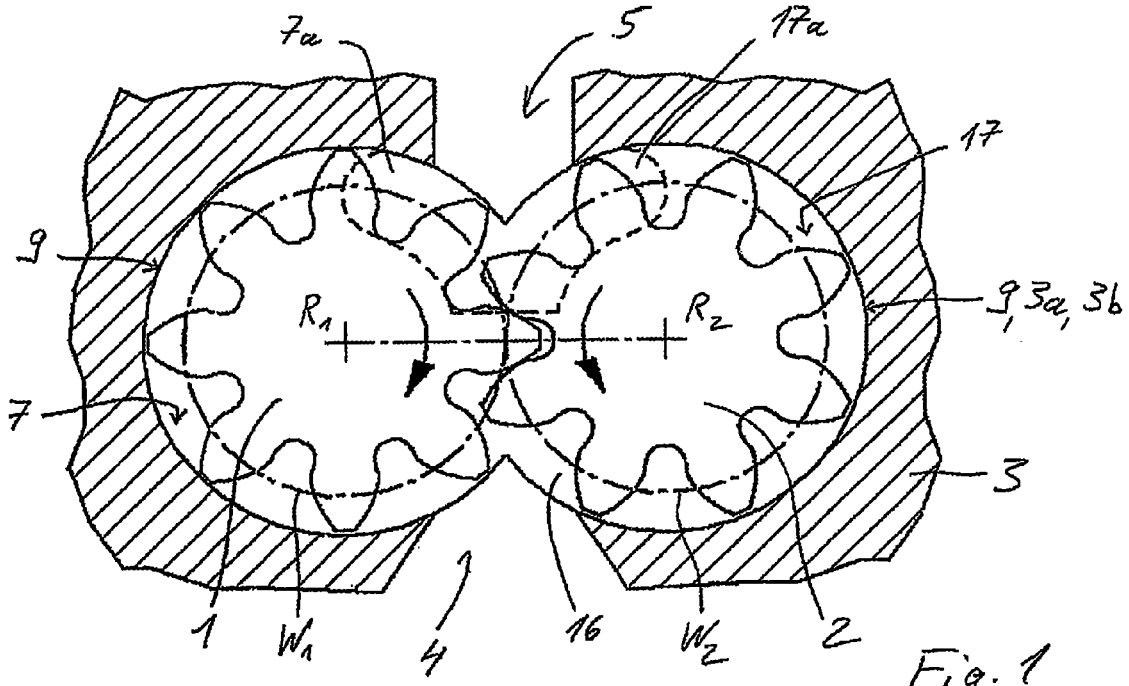
FIG. 1 is a cross-sectional view of a delivery chamber of an external toothed wheel pump comprising two delivery rotors in toothed engagement.

FIG. 1 shows a cross-section of an external toothed wheel pump. In a pump casing comprising a casing portion 3 and a cover 6 (FIG. 2), a delivery chamber is formed in which two externally toothed delivery rotors 1 and 2 in the form of externally toothed wheels are mounted such that they can rotate about parallel rotational axes $R_1$ and $R_2$. The delivery rotor 1 is rotary driven, for example by the crankshaft of an internal combustion engine of a motor vehicle. The delivery rotors 1 and 2 are in toothed engagement with each other, such that when the delivery rotor 1 is rotary driven, the delivery rotor 2 mating with it is also rotationally driven. An inlet 4 feeds into the delivery chamber on a low-pressure side, and an outlet 5 on a high-pressure side, for a fluid to be delivered, preferably lube oil for an internal combustion engine. The casing portion 3 forms a radial sealing surface 9 which faces each of the delivery rotors 1 and 2 in the radial direction and encloses the respective delivery rotor 1 or 2 circumferentially, forming a narrow radial sealing gap. For the delivery rotor 1, the casing 3, 6 also forms an axial sealing surface on each front face of the delivery rotor 1, axially facing it, of which the sealing surface 7 can be seen in FIG. 1. Another axial sealing surface is formed axially facing each of the two front faces of the delivery rotor 2, of which the sealing surface 17 can be seen in the cross-section in FIG. 1.

By rotary driving the delivery rotors 1 and 2, fluid is suctioned into the delivery chamber through the inlet 4 and, in the tooth gaps of the delivery rotors 1 and 2, delivered through the respective enclosure to the high-pressure side of the delivery chamber, where it is delivered through the outlet 5 to the consumer—in the assumed example, the internal combustion engine. During the delivery action, the high-pressure side is separated from the low-pressure side by the sealing gaps formed between the delivery rotors 1 and 2 and the sealing surfaces cited, and by the toothed engagement of the delivery rotors 1 and 2. The delivery rate of the pump increases in proportion to the rotational speed of the delivery rotors 1 and 2. Since, above a certain limiting rotational speed, the internal combustion engine—assumed as the consumer by way of example—absorbs less lube oil than the pump would deliver in accordance with its characteristic curve which increases in proportion to the rotational speed, the delivery rate of the pump is regulated above the limiting rotational speed. For regulation, the delivery rotor 2 can be moved axially, i.e. along its rotational axis $R_2$, back and forth relative to the delivery rotor 1, such that the engagement length of the delivery rotors 1 and 2, and correspondingly the delivery rate, can be changed.

Figure 2:
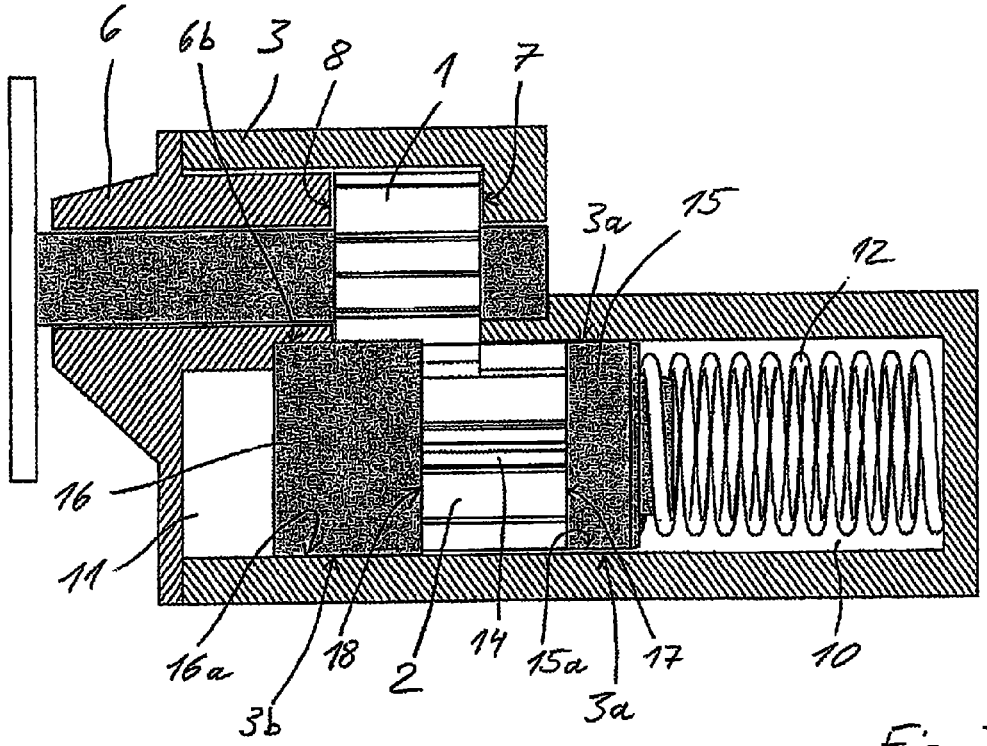
FIG. 2 is a longitudinal cross-sectional view of the external toothed wheel pump.

In FIG. 2, the delivery rotor 2 assumes an axial position exhibiting an axial overlap, i.e. an engagement length, which has already been reduced as compared to the maximum engagement length. The delivery rotor 2 is part of an adjusting unit consisting of a bearing journal 14, an actuating member 15, an actuating member 16 and the delivery rotor 2 which is mounted on the bearing journal 14 between the actuating members 15 and 16 such that it can rotate. The bearing journal 14 connects the actuating members 15 and 16 to each other, secure against rotation. The actuating member 16 forms the axial sealing surface 17 facing the delivery rotor 2. The actuating member 15 forms the other axial sealing surface 18. The entire adjusting unit is mounted, secured against rotation, in a shifting space of the pump casing 3, 6, such that it can shift axially back and forth.

The casing is formed by the casing portion 3 and the casing cover 6 which is fixedly connected to it. The casing cover 6 is formed with a base, the front face of which facing the delivery rotor 1 forms the sealing surface 7. On the opposite front face, the casing portion 3 forms the fourth axial sealing surface 8 which axially faces the delivery rotor 1. The side of the sealing surface 8 facing the adjusting unit is provided with a circular segment-shaped cutaway for the actuating member 15. The side of the actuating member 16 facing the delivery rotor 1 is provided with a circular segment-shaped cutaway for the base 6 forming the sealing surface 7. Apart from the respective cutaway, the sealing surface 7 corresponds to the sealing surface 8, and the sealing surface 17 corresponds to the sealing surface 18.

The adjusting members 15 and 16 of the example embodiment are adjusting pistons. The shifting space in which the adjusting unit can be moved axially back and forth comprises a partial space 10 which is limited by the rear side of the actuating member 15 and a partial space 11 which is limited by the rear side of the actuating member 16. The partial space 11 is connected to the high-pressure side of the pump and is constantly charged with pressurized fluid diverted there, thus acting on the rear side of the actuating member 16. A mechanical pressure spring is arranged in the space 10 as an elasticity member 12, the elasticity force of which acts on the rear side of the actuating member 15. The elasticity member 12 counteracts the pressure force acting on the actuating member 16 in the partial space 11. The regulation of such external toothed wheel pumps is known and does not therefore need to be explained. The regulation can in particular be configured in accordance with DE 102 22 131 B4.

If the axial sealing surfaces 7, 8 and 17, 18 were circumferentially smooth and the axial sealing gaps correspondingly circumferentially narrow, fluid on the high-pressure side in the engagement region of the delivery rotors 1 and 2 would be squeezed, i.e. compressed even beyond the pressure of the high-pressure side, and delivered to the low-pressure side. A drive output is consumed for squeezing the fluid, and a delivery flow pulsation is also associated with the particular compression of the fluid and its transport through the toothed engagement.

In order to eliminate the disadvantages cited, the sealing surfaces 7, 8, 17 and 18 are each provided with a relieving pocket on the high-pressure side. Of the four pockets, the pockets 7*a* and 17*a* can be seen in FIG. 1. Relieving pockets are only formed on the high-pressure side. The casing portion 3 guides the actuating members 15 and 16 in a sliding contact. For the sliding contact, the casing portion 3 forms a track 3*a* and the casing portion 3 together with the cover 6 forms a track 3*b*, 6*b*. The actuating members 15 and 16 each form an actuating member sliding surface 15*a* and 16*a* at their outer circumferential surface. More specifically, the track 3*a* and the actuating member sliding surface 15*a* on the one hand, and the track 3*b*, 6*b* and the actuating member sliding surface 16*a* on the other hand, are in sliding contact. In the prior art, it is usual to produce the casing 3, 6 and the actuating members 15 and 16 from light metal alloys. In the friction systems formed from the tracks 3*a* and 3*b*, 6*b* on the one hand and the actuating member sliding surfaces 15*a* and 16*b* on the other hand, a particular sliding material forms at least one of each of the sliding partners of the relevant friction system, wherein in the friction system 3*a*/15*a*, either the track 3*a* or the actuating member sliding surface 15*a* can be formed by the sliding material. The same sliding material can also form both the track 3*a* and the actuating member sliding surface 15*a*. Lastly, the two sliding surfaces 3*a* and 15*a* can each be formed by a different sliding material. The same applies in relation to the other friction system 3*b*, 6*b*/16*a*. If only one of the sliding partners of the respective friction system consists of the sliding material, the same sliding material is expediently used in each case. If both friction partners consist of a sliding material, the actuating member sliding surfaces 15*a* and 16*b* are each formed by the same sliding material or the tracks 3*a*, 3*b* and 6*b* are each formed by the same sliding material.

Although in principle one of the sliding partners in the respective friction system can consist of a metal alloy, preferably a light metal alloy, it is in accordance with preferred example embodiments if each of the sliding partners is formed by a particular sliding material having a low adhesion energy. The sliding material of the sliding partners of the respective friction system can be the same or can be different. The actuating members 15 and 16 can be formed entirely from the sliding material, or can be formed from a substrate material, preferably a light metal alloy, and each superficially comprise a sliding layer made of the sliding material. The casing—in the example embodiment, the casing portion 3 and the cover 6—can also be formed from plastic, however in preferred example embodiments, at least the casing portion 3 and preferably the cover 6 are cast from a metal alloy, preferably a light metal alloy. Aluminum alloys may in particular be considered as the light metal. Preferred examples are given below:

Example 1 casing portion 3 and cover 6: each made of an AlSi9Cu3(Fe) die cast actuating members 15 and 16: PES compound: 10% by weight of carbon fibers, 10% by weight of graphite, 10% by weight of PTFE, remainder PES (e.g. ULTRASON®)

In Example 1, the casing portion 3 and the cover 6 are each formed from the same aluminum alloy, namely AlSi9Cu3, by die casting. The alloy can contain a small proportion of iron. The tracks 3*a*, 3*b* and 6*b* are obtained in an exact fit by being mechanically machined. The actuating members 15 and 16 are each formed entirely from the specified plastic sliding material. The sliding surfaces 15*a* and 16*a* are produced in an exact fit by being mechanically machined.

Example 2 casing portion 3 and cover 6: each made of an AlSi9Cu3(Fe) die cast actuating members 15 and 16: PES compound: 10% by weight of carbon fibers, 10% by weight of graphite, 10% by weight of PTFE, remainder PES (e.g. ULTRASON®)

tracks 3*a*, 3*b* and 6*b*: coated with plastic or sliding varnish modified to lubrication Except for the tracks 3*a*, 3*b* and 6*b*, Example 2 corresponds to Example 1. Unlike Example 1, however, each of the tracks 3*a*, 3*b* and 6*b* is formed by a sliding layer of plastic sliding material or sliding varnish. The plastic sliding material can in particular be the material of the actuating members 15 and 16.

Example 3 casing portion 3 and cover 6: each made of an AlSi9Cu3(Fe) die cast actuating members 15 and 16: extruded parts made of a cast aluminum semi-finished product as the substrate material, for example AlSi8Cu3 sliding surfaces 15*a* and 16*a*: PES compound: 10% by weight of carbon fibers, 10% by weight of graphite, 10% by weight of PTFE, remainder PES (e.g. ULTRASON®)

The casing portion 3 and the cover 6 correspond to Example 1. The actuating members 15 and 16 each consist of the same aluminum alloy, preferably AlSi8Cu3. They are formed from a cast semi-finished product of the aluminum alloy, by extrusion. At least the circumferential surfaces are then each provided with a sliding layer of the plastic sliding material. Instead of forming the blanks of the actuating members 15 and 16 by extrusion, the blanks can be formed by sintering and calibrating. The extruded or calibrated blanks are heated and the plastic sliding material is injection-molded around them in a die, preferably completely enclosing them.

Example 4 casing portion 3 and cover 6: each made of an AlSi9Cu3(Fe) die cast tracks 3*a*, 3*b* and 6*b*: Hardcoat® smooth (Hardcoat® smooth sliding layer, preferably impregnated with PTFE)

actuating members 15 and 16: extruded parts made of a cast aluminum semi-finished product as the substrate material, for example AlSi8Cu3 sliding surfaces 15*a* and 16*a*: Hardcoat® smooth (Hardcoat® smooth sliding layer, preferably impregnated with PTFE)

The casing portion 3 and the cover 6 correspond to Example 1. The actuating members 15 and 16 each consist of the same aluminum alloy, preferably AlSi8Cu3. They are either formed from a cast semi-finished product by extrusion or alternatively by sintering and calibrating. The actuating member blanks are then anodized at least on their circumferential surface forming the respective sliding surface 15*a* and 16*a*. A mixture of oxalic acid and additives is used as the electrolyte, such that a sliding layer of $Al_2O_3$ Hardcoat® smooth is formed on each of the outer circumferential surfaces. The sliding layer is preferably impregnated with PTFE. The tracks 3*a*, 3*b* and 6*b* are formed in the same way, also each as a Hardcoat® smooth sliding layer, preferably as a PTFE-impregnated sliding layer.

In a modification, one of the two sliding partners or also both sliding partners can each be formed as a Hardcoat® sliding layer, also preferably as a PTFE-impregnated sliding layer.

Example 5 casing portion 3 and cover 6: each made of an AlSi9Cu3(Fe) die cast tracks 3*a*, 3*b* and 6*b*: Hardcoat® sliding layer actuating members 15 and 16: steel, for example 30CrMoV9, as the substrate material sliding surfaces 15*a* and 16*a*: nitrided steel The casing portion 3 and the cover 6 correspond to Example 1 and, once formed, are anodized such that the tracks 3*a*, 3*b* and 6*b* are obtained as an $Al_2O_3$ Hardcoat® (Hardcoat® sliding layer). The Hardcoat® sliding layer can be impregnated with PTFE. The actuating members 15 and 16 are formed from steel and nitrided on their surface, at least on their outer circumferential surfaces.

Example 6 casing portion 3 and cover 6: AlSi8Cu3 sand cast or chill cast actuating members 15 and 16: extruded parts made of a cast aluminum semi-finished product as the substrate material, for example AlSi8Cu3 sliding surfaces 15*a* and 16*a*: Hardcoat® smooth (Hardcoat® smooth sliding layer)

The casing portion 3 and the cover 6 are each formed from AlSi8Cu3 by sand casting or chill casting. The tracks 3*a*, 3*b* and 6*b* are produced in an exact fit by being mechanically machined. The actuating members 15 and 16 are each formed from a cast aluminum semi-finished product by extrusion, and anodized. A mixture of oxalic acid and additives is used as the electrolyte, such that a sliding layer of $Al_2O_3$ Hardcoat® smooth (Hardcoat® smooth sliding layer) is formed on each of the outer circumferential surfaces. The Hardcoat® smooth sliding layer preferably contains PTFE.

In a modification, a Hardcoat® ceramic or Hardcoat® smooth ceramic also forms the tracks 3*a*, 3*b* and 6*b*, wherein here, too, the ceramic can advantageously be impregnated with PTFE.

The method of manufacture and choice of materials in the last example embodiment is particularly suitable for smaller-volume runs, while forming the casing portions 3 and 6 by die casting is the better choice for large-volume runs. Metal-ceramic sliding layers are particularly suitable for use in friction systems comprising a light-metal sand cast structure or chill cast structure or light-metal cast alloys in general which are solidified at or near thermodynamic equilibrium. In conjunction with die cast parts as sliding partners, the α-mixed crystals—for example AlSi—of the die cast structure, which are smaller due to the shorter cooling time, cause problems which for metal-oxide ceramic sliding layers act as fine abrasive grains. If one of the sliding partners comprises a die cast structure or a metastable phase in general on its sliding surface, then heat-resistant thermoplasts modified to lubrication are the better choice, or each of the two sliding partners should comprise a Hardcoat® sliding layer or Hardcoat® smooth sliding layer. Even for sand cast structures or chill cast structures, however, both sliding partners preferably consist of a sliding material having a low adhesion energy.

In the foregoing description, preferred embodiments of the invention have been presented for the purpose of illustration and description. They are not intended to be exhaustive or to limit the invention to the precise form disclosed. Obvious modifications or variations are possible in light of the above teachings. The embodiments were chosen and described to provide the best illustration of the principals of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled to.

What is claimed is:

1. A rotary pump having a variable delivery volume, comprising:

a casing;

a delivery chamber formed in the casing and comprising an inlet for a fluid on a low-pressure side and an outlet for the fluid on a high-pressure side of the pump;

at least one delivery rotor which can be rotated in the delivery chamber about a rotational axis;

a first actuating member which is arranged facing a front face of the delivery rotor, and can be moved back and forth in the casing for adjusting the delivery volume;

the first actuating member being chargeable, in the direction of its mobility, with an actuating force which is dependent on a fluid requirement;

a first track which is formed in the casing and guides the first actuating member on a first actuating member sliding surface in a sliding contact;

a sliding material which forms at least one of the first actuating member sliding surface and the first track;

the first actuating member, a second actuating member and the delivery rotor are part of an adjusting unit which can be moved as a whole back and forth in the casing;

the first and second actuating members are each arranged facing one of the front faces of the delivery rotor, and a second track is formed in the casing which guides the second actuating member on its second actuating member sliding surface in a sliding contact;

at least one of the second actuating member sliding surface of the second actuating member and the second track consists of the sliding material;

wherein the sliding material is a thermoplastic modified with a lubricant;

wherein the sliding material is a polymer compound of at least one heat-resistant polymer filled with carbon fibers and a sliding additive comprising at least one of graphite and fluoropolymer.

2. The rotary pump according to claim 1, wherein the sliding material forms the first actuating member sliding surface and the second actuating member sliding surface.

3. The rotary pump according to claim 1, wherein the sliding material exhibits an adhesion energy relative to an opposed material which is at most half an adhesion energy of aluminum relative to the same material.

4. The rotary pump according to claim 1, wherein the sliding material comprises PTFE.

5. The rotary pump according to claim 4, wherein the proportion of polymer is at least 60% by weight and at most 80% by weight.

6. The rotary pump according to claim 4, wherein the proportion of the sliding additive is at least 10% by weight and at most 30% by weight.

7. The rotary pump according to claim 4, wherein the proportion of the carbon fibers is at least 5% by weight and at most 15% by weight.

8. The rotary pump according to claim 1, wherein the at least one heat-resistant polymer is a polymer including copolymer, a mixture of polymers or a polymer blend from the group consisting of polyether sulphone (PES), polysulphone (PSU) and polyphthalamide (PPA).

9. The rotary pump according to claim 1, wherein the at least one heat-resistant polymer is a polymer including copolymer, a mixture of polymers or a polymer blend from the group consisting of polyphenylene sulfide (PPS), polyether ketones (PAEK, PEK, PEEK) and polyamide (PA).

10. The rotary pump according to claim 1, wherein the track is formed by a metal-ceramic layer.

11. The rotary pump according to claim 1, wherein nitrided steel or TiCN forms the first and second tracks.

12. The rotary pump according to claim 1, wherein a casing portion comprising at least one of the first and second tracks at least substantially consists of metal or is formed from a metal as a substrate material and a sliding layer of a second sliding material forming at least one of the first and second tracks is applied to the substrate material or is formed by modifying the substrate material.

13. The rotary pump according to claim 12, wherein a casting material forms the casing portion or the substrate material of the casing portion.

14. The rotary pump according to claim 13, wherein the casting material is a die casting material, a chill casting material or a sand casting material.

15. The rotary pump according to claim 12, wherein the metal is aluminum or an aluminum-based alloy or another light metal.

16. The rotary pump according to claim 15, wherein the metal is aluminum or an aluminum-based alloy which contains silicon, or the metal is an aluminum-based alloy containing at least one of copper and iron.

17. The rotary pump according to claim 12, wherein a ceramic material of the substrate material forms the sliding layer of the second sliding material.

18. The rotary pump according to claim 17, wherein the ceramic material of the substrate material is aluminum oxide (Al203).

19. The rotary pump according to claim 1, wherein at least one of the first and second actuating members including its respective actuating member sliding surface is formed from a metal as a substrate material and a sliding layer of the sliding material forming the respective actuating members sliding surface is applied to the substrate material.

20. The rotary pump according to claim 19, wherein a casing portion comprising the at least one of the first and second tracks at least substantially consists of metal or is formed from a metal as a substrate material and a sliding layer of a second sliding material forming the at least one of the first and second tracks is applied to the substrate material or is formed by modifying the substrate material, and wherein the metal of the casing portion and the metal of the at least one of the first and second actuating members contain the same metallic element at least as their respective main constituent.

21. The rotary pump according to claim 1, wherein the casing, or at least a casing portion which forms at least one of the first and second tracks, is formed from the sliding material.

22. The rotary pump according to claim 1, wherein the actuating force is arranged to counteract an elasticity member, or at least one of the first and second actuating members is an actuating piston configured to be charged with the fluid of the high-pressure side.

23. The rotary pump according to claim 1, wherein the delivery rotor and at least one of the first and second actuating members can be axially moved in relation to the rotational axis.

24. The rotary pump according to claim 1, comprising another delivery rotor which can be rotated in the delivery chamber about another rotational axis, wherein the delivery rotors are in delivery engagement with each other.

25. The rotary pump according to claim 1, wherein the pump is an external-axle rotary pump or an external toothed wheel pump.

26. The rotary pump according to claim 1, wherein the casing is formed from an aluminum-based alloy by sand casting, chill casting or die casting, and the first and second tracks are formed by mechanically machining the casting material.

27. A method for manufacturing a rotary pump having a variable delivery volume and including a casing, a delivery chamber formed in the casing and comprising an inlet for a fluid on a low-pressure side and an outlet for the fluid on a high-pressure side of the pump, at least one delivery rotor rotatable in the delivery chamber about a rotational axis, an actuating member which is arranged facing a front face of the delivery rotor or surrounds the delivery rotor, and is moveable in the casing for adjusting the delivery volume and chargeable, in the direction of its mobility, with an actuating force which is dependent on a fluid requirement, and a track which is formed in the casing and guides the actuating member on an actuating member sliding surface in a sliding contact; the method comprising:

a) forming a casing portion forming the track from a metal;

b) forming at least a portion of the actuating member from a metal; and c) injection molding a plastic sliding layer around at least one of the casing portion forming the track or the portion of the actuating member formed from a metal wherein the sliding surface is formed by a surface of a plastic sliding layer.

28. The method according to claim 27, wherein at least one of the casing portion forming the track and the at least a portion of the actuating member is formed from a light metal.

29. The method according to claim 27, wherein the casing portion is formed from an aluminum-based alloy by sand casting, chill casting or die casting, and the track is preferably formed by mechanically machining the casting material.

30. The method according to claim 27, wherein the plastic sliding layer contains a sliding additive.

* * * * *